US010035171B2

(12) United States Patent
Boukair et al.

(10) Patent No.: US 10,035,171 B2
(45) Date of Patent: Jul. 31, 2018

(54) PAINT ROLLER SHIELD

(71) Applicants: Moe Boukair, Redondo Beach, CA (US); Ronald Boukair, Skaneateles, NY (US)

(72) Inventors: Moe Boukair, Redondo Beach, CA (US); Ronald Boukair, Skaneateles, NY (US)

( * ) Notice: Subject to any disclaimer, the term of this patent is extended or adjusted under 35 U.S.C. 154(b) by 0 days.

(21) Appl. No.: 15/549,123

(22) PCT Filed: Feb. 6, 2016

(86) PCT No.: PCT/IB2016/050624

§ 371 (c)(1),
(2) Date: Aug. 4, 2017

(87) PCT Pub. No.: WO2016/125125

PCT Pub. Date: Aug. 11, 2016

(65) Prior Publication Data

US 2018/0029068 A1 Feb. 1, 2018

Related U.S. Application Data

(63) Continuation-in-part of application No. 14/616,640, filed on Feb. 6, 2015, now Pat. No. 9,199,266.

(51) Int. Cl.
*A46B 17/00* (2006.01)
*B05C 17/02* (2006.01)

(52) U.S. Cl.
CPC ..... *B05C 17/0225* (2013.01); *A46B 17/00* (2013.01); *B05C 17/0222* (2013.01)

(58) Field of Classification Search
CPC .. A46B 17/00; B05C 17/0222; B05C 17/0225
See application file for complete search history.

(56) References Cited

U.S. PATENT DOCUMENTS 2,644,186 A * 7/1953 Guimond ..... B05C 17/02 15/166
2,763,022 A * 9/1956 Glacken ..... B05C 17/02 15/230.11
2,799,886 A * 7/1957 Brunelli ..... B05C 17/0217 15/230.11

(Continued)

FOREIGN PATENT DOCUMENTS

DE 44 19 672 * 8/1995
WO WO 94/00245 * 1/1994

*Primary Examiner* — Randall Chin
(74) *Attorney, Agent, or Firm* — Michael D. Eisenberg

(57) ABSTRACT

A paint roller and paint roller shield assembly comprises a roller for applying paint, having a paint applying surface that terminates at a rim located at an end of the roller. A paint roller shield, connected to the end of the roller, comprises a plate with a planar surface having a substantially round and beveled peripheral edge and a curved cutout configured as a missing portion of the plate. The beveled peripheral edge is angled and sloped outwardly away from the planar surface. In a plan view of the plate, the cutout exposes a part of the rim comprising part of the paint applying surface of the roller and wherein the plate and the beveled peripheral edge covers a remaining part of the rim of the roller not exposed by the cutout.

15 Claims, 8 Drawing Sheets

(56) References Cited

U.S. PATENT DOCUMENTS

| | | | | | |
|---|---|---|---|---|---|
| 2,836,840 | A * | 6/1958 | Pratt | B05C 17/0212 | 15/230.11 |
| 3,369,269 | A * | 2/1968 | Deck | B05C 17/02 | 15/114 |
| 3,685,084 | A * | 8/1972 | Bennett | B05C 17/02 | 15/230.11 |
| 4,599,762 | A * | 7/1986 | Rigter | B05C 17/0225 | 15/248.2 |
| 5,623,740 | A * | 4/1997 | Burns | B05C 17/02 | 118/252 |
| 6,687,945 | B2 * | 2/2004 | Robinson | B05C 17/02 | 15/230.11 |
| 6,925,674 | B2 * | 8/2005 | Prince | B05C 17/02 | 15/230.11 |

* cited by examiner

PAINT ROLLER SHIELD

CROSS-REFERENCES TO RELATED APPLICATIONS

This application claims priority from U.S. application Ser. No. 14/616,640 filed on Feb. 6, 2015, now U.S. Pat. No. 9,199,266, which is hereby incorporated herein by reference in its entirety.

TECHNICAL FIELD

The present invention, in some embodiments thereof, relates to paint applicators, specifically rollers and shields, for precision in painting large scale projects.

BACKGROUND OF THE INVENTION

Painting rooms or walls often requires protecting areas that are not intended to be painted. Traditionally this has been done through slow but precise painting, using tarps to cover areas, and using painter's tape. All of these have problems such as increased time spent on projects, inadequate protection, and damages due to adhesive materials. Some devices utilize a method that creates a gap between the paint area and area that should remain unpainted, but this gap is of a size that either requires extreme care or the need to fill in the gap with a more precise means later. An improved paint applicator is needed that allows a user speed, adequate protection, and precision while painting, for example, walls near the ceiling.

BRIEF SUMMARY OF EMBODIMENTS OF THE INVENTION

There is a need for an improved apparatus for painting walls near the junction between the wall and a ceiling or ornamental structure near the ceiling such as crown molding.

The present invention relates to a shield for a paint roller that allows for quick and precise painting.

One embodiment of the invention includes shield that may be attached to different types of existing paint rollers. Another embodiment of the invention has a handle attached to a frame, which attaches to a shield and roller. The handle allows for an easy grip. The frame includes a neck. This neck may have alternate configurations depending on the type of work such as for walls generally, or with a longer neck for high ceilings.

In one configuration, the neck forms an "s" shape with the handle extending away from the lower leg of the "s" and the shield extending off of the upper leg. The frame also includes a roller to which the roller cover is applied. The roller cover is the portion that applies paint to a wall. In one embodiment the roller itself is connected to the frame and moves concentrically using the leg of the frame it is attached to as an axel. Alternatively there may be device that rotates concentrically about the leg of the frame that the roller cover attaches to. In this embodiment the roller has a ¾ inch outer diameter while the roller cover has an inner diameter of ¾ inch and a length of 4 inches. The frame and shield may be designed to accommodate a variety of roller covers.

The shield has a stem and a plate. The shield is designed for the planar plate portion to be flush against a surface, such as a ceiling. This surface, such as a ceiling, is generally perpendicular to the surface that is intended to be painted, such as the wall. The stem, which is optionally shaped cylindrically, allows the shield to attach to the frame. In one embodiment this is achieved by the stem being hollow and having one base that is open. The second base is attached to the plate. In one embodiment the plate is substantially planar, circular and with one edge flattened, as though someone had cut through a secant line. The diameter in this embodiment is 1½ inches. The size of the shield is based on the diameter of the roller cover such that all of the edge of the roller cover will be blocked by the shield except for the flattened portion of the shield. This plate has a width that allows the roller cover to come within a very close proximity of area that is not intended to be painted, such as a ceiling. In this embodiment it has a 1/64 inch thickness with a beveled ⅛ inch edge angled at 45 degrees away from the ceiling (or other surface not intended to be painted). There is no angled portion on the flat edge of the shield that has been cut as though through a secant line. The shield is designed such that the flat portion will press against wall that is intended to be painted and can be arranged at whatever angle the user desires. Once placed the shield will not rotate but will stay fixed with the frame as the roller and roller cover rotate about an axel formed by the frame.

In this embodiment the shield is made from polypropylene #5, but may be made from other materials or plastics.

In another embodiment of the invention the beveled edge may have different proportions regarding the angle and length.

In another embodiment the diameter of the shield can differ from the 1½ inch. This diameter was selected to utilize an appropriately reduced amount of materials necessary for a shield for a roller cover with an inner diameter of ¾ inches. The diameter of the shield, the location of the secant line forming the flattened portion of shield, and size of the roller cover may all differ from the current embodiment, though they must remain in relation to one another such that the diameter of the shield is greater than the outer diameter of the roller cover, but allowing the roller cover to extend past the flat portion. It is possible in other embodiments that the shield not be generally circular. Other shapes may be used. However there must be one flat edge that does not extend past the roller cover and allows the paint to be applied to the intended surface.

In another embodiment the stem of the shield can alter to configure to differently shaped termini of frames.

In another embodiment the frame may be configured in a different formation such as straight or an "s" shape with a handle extending perpendicular to lower leg of the "s".

The present invention relates to a paint roller shield comprising a plate with a planar surface configured to have a beveled periphery with at least one flat edge along the periphery and a nonplanar surface configured to attach to a paint roller device.

The paint roller shield is subject to variations. The plate, in a variation, is substantially round with one flat edge configured to allow paint to be applied to one particular surface. The attachment to the paint roller device, in one variation, is a hollow cylindrical tube configured to fit over the end of a paint roller device and stay fixed in relation to a roller cover, which applies paint.

The beveled edge, in a variation, is angled between 5° and 85° and slopes outwardly away from the planar surface. In another variation to the beveled edge, it is at a length of about ⅛ of an inch. In yet another variation on the beveled edge, the flat edge remains unbeveled. Furthermore, in one variation of the flat edge of the plate is configured such that with a substantially circular plate edge is configured as a missing portion of the circle defined by a secant.

In variants of the shield, it may be configured with a diameter of at least 1.5 inches to accommodate a 4 inch roller cover with an inner diameter of 0.75 inches, but may also be configured with similar ratios depending on the size of the roller cover.

In another variant, a paint roller and paint roller shield assembly comprises: a roller for applying paint, having a paint applying surface that terminates at a rim located at an end of the roller. A paint roller shield is connected to the end of the roller, and comprises: a plate with a planar surface having a substantially round and beveled peripheral edge and a curved cutout configured as a missing portion of the plate. The beveled peripheral edge is angled and sloped outwardly away from the planar surface. In a plan view of the plate, the cutout exposes a part of the rim comprising part of the paint applying surface of the roller and wherein the plate and the beveled peripheral edge covers a remaining part of the rim of the roller not exposed by the cutout.

Optionally, the beveled peripheral edge is angled between 0° and 90.

Optionally, the curved edge is unbeveled.

Optionally the curved cutout has an edge with a radius of curvature that is larger than a radius curvature of the peripheral edge.

In a further variant, a paint roller and paint roller shield assembly comprises a roller for applying paint, having a paint applying surface that terminates at a rim located at an end of the roller. A paint roller shield, connected to the end of the roller, comprises a plate with a planar surface having a substantially round and beveled peripheral edge and a cutout defined by a missing portion of the plate. A hollow cylindrical tube is configured to fit over the end of the roller and remains rotatably fixed in relation to the roller when the roller rotates, which applies paint. In a plan view of the plate, the cutout exposes a part of the rim comprising part of the paint applying surface of the roller and wherein the plate and the beveled peripheral edge covers a remaining part of the rim of the roller not exposed by the cutout.

Optionally, the cutout has a flat portion defined by a secant.

Optionally, the cutout has a curved edge.

In another variant of the invention, a paint roller shield comprises a plate with a planar surface having a substantially round and beveled peripheral edge and a curved cutout configured as a missing portion of the plate. The beveled peripheral edge is angled and sloped outwardly away from the planar surface. In a plan view of the plate, and when connected to the shield, the cutout exposes a part of a rim of a paint applying surface of a roller and wherein the plate and the beveled peripheral edge covers a remaining part of the rim of the roller not exposed by the cutout.

Optionally, the curved cutout has an edge with a radius of curvature that is larger than a radius curvature of the peripheral edge.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Broadly the invention includes a paint roller assembly that includes a shield 100.

Figure 1:
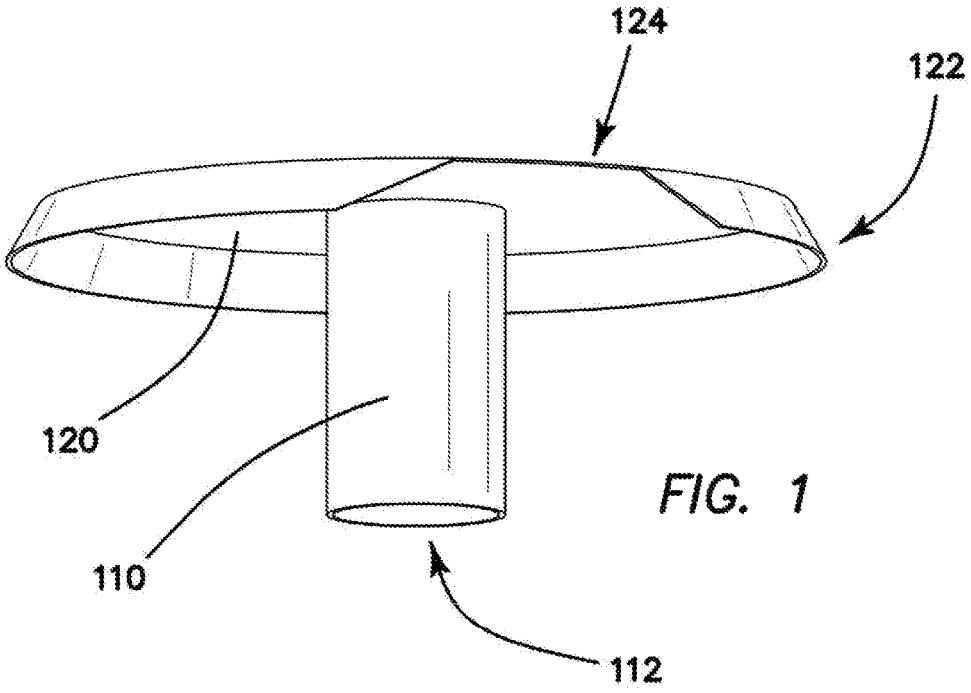
FIGS. 1 and 2 show two different perspective views of the shield.
Figure 2:
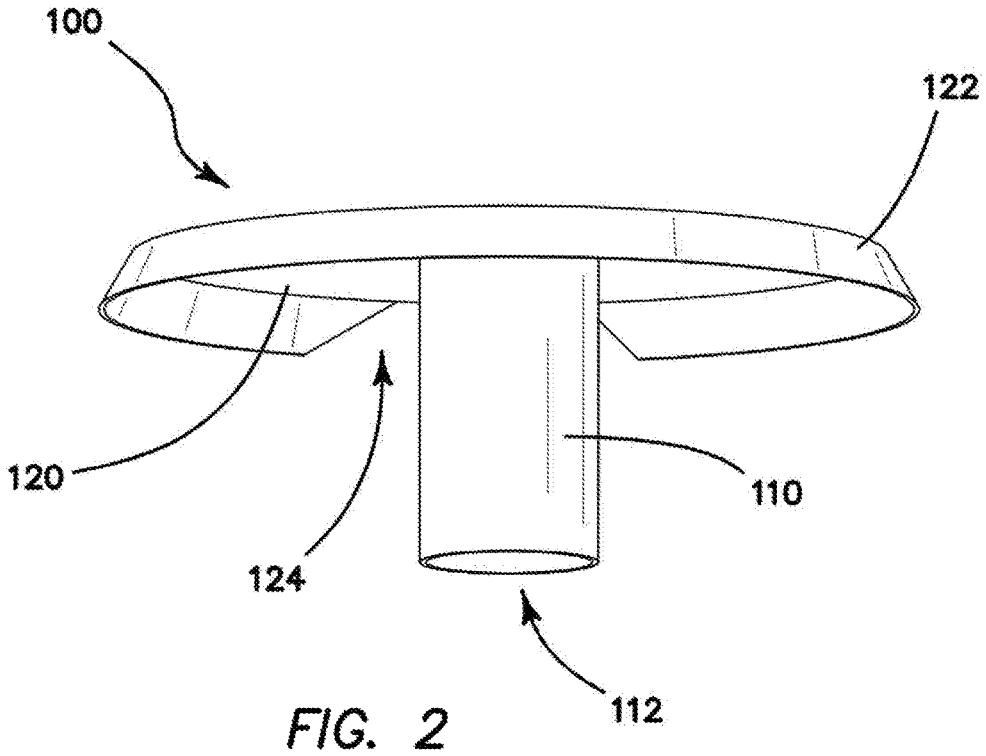

The following reference numbers are used in this document:

100 shield
110 stem
112 hollow interior
120 plate
122 beveled edge
124 flat portion
124*a* and 124*b* to points forming a secant line
400 roller cover
410 frame
412 frame terminus
600 handle
610 roller
800 paint roller shield
810 beveled peripheral edge
820 curved cutout The present invention relates to a paint roller assembly that includes a shield 100. In one embodiment, FIGS. 1 and 2 show two different perspective views of the shield 100. In this embodiment, the shield 100 has a stem 110 and a plate 120. The stem 110 is generally cylindrical and has a hollow interior 112 leading to the exterior on one side. The stem 110 is connected to the middle of the plate 120 at the other side. The plate 120 is generally flat and round. The plate 120 has a beveled edge 122 extending downwards from the plate. In this embodiment the beveled edge 122 is at a 45 degree angle, though it can range from 5 to 85 degrees. In this embodiment the beveled edge 122 is at a length of ⅛ of an inch.

The plate 120 and beveled edge have a flat portion 124

Figure 3:
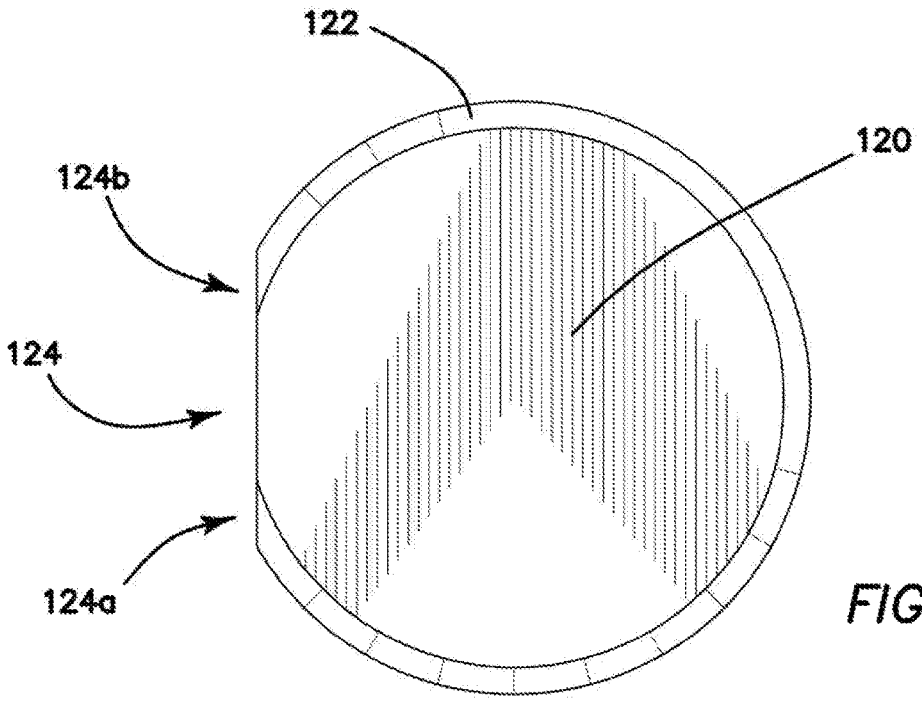
FIG. 3 shows a top view of the shield.

FIG. 3 illustrates a top view of the shield 100. The flat portion 124 is formed as though a section were cut off of a circle by a secant line connecting 124*a* and 124*b*. This means that the flat portion 124 itself has no beveled edge 122 but can rest flush against a wall while the plate 120 rests against a perpendicular ceiling.

Figure 4:
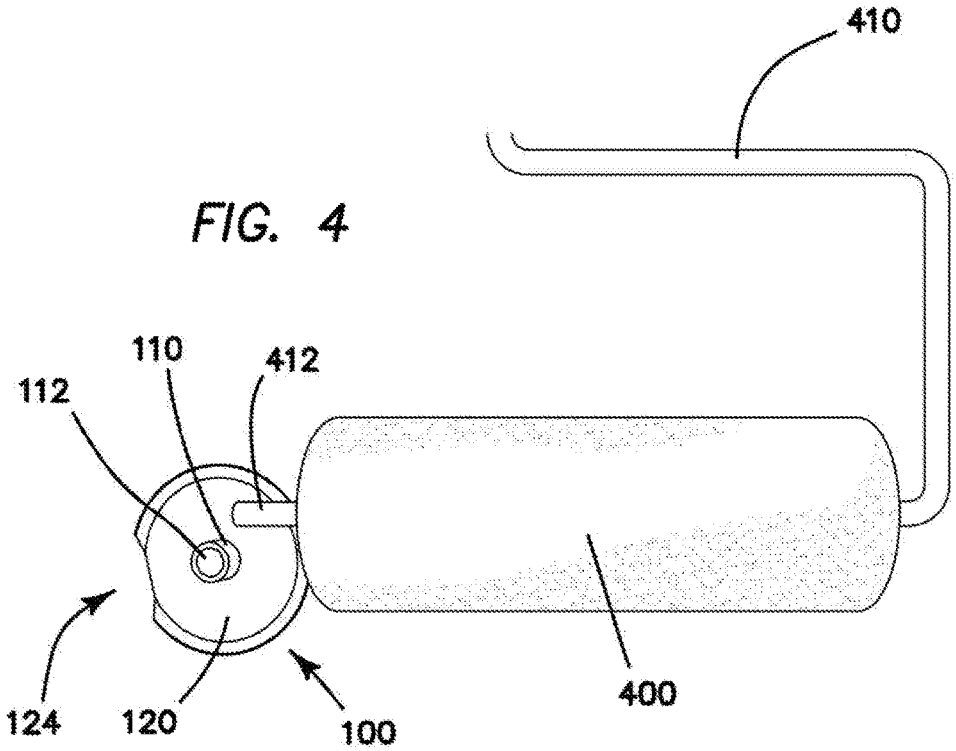
FIG. 4 shows the shield, frame, and roller cover with the shield separated.
Figure 5:
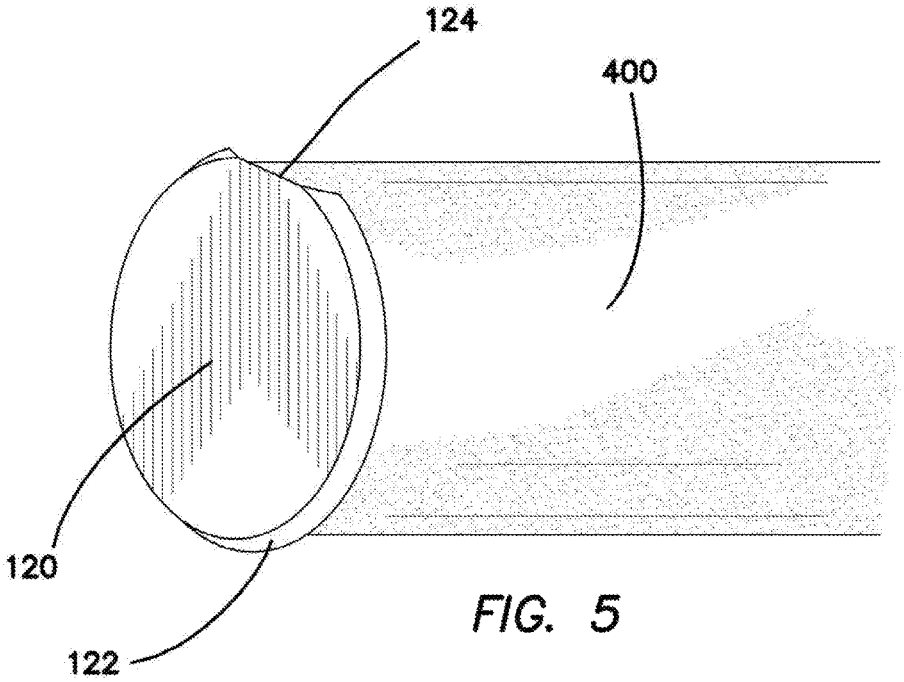
FIG. 5 shows the shield, frame, and roller cover together.

FIG. 4 shows the shield 100, frame 410, and roller cover 400 with the shield 120. The hollow interior 112 is visible in this view and can be attached at this point to the frame terminus 412. The shield 100 does not rotate about this terminus 412. In this embodiment it remains removably attached as can be seen in FIG. 5. In another embodiment, the shield 100 may remain permanently attached to the terminus 412. FIG. 5 further shows that the diameter of the shield 100, which is 1½ inches in this embodiment, configured to extend past the edge of a roller cover 400. An exception is the flat portion 124, which is designed to have roller cover 400 extend past it by the secant line from 124*a* to 124*b*.

Figure 6:
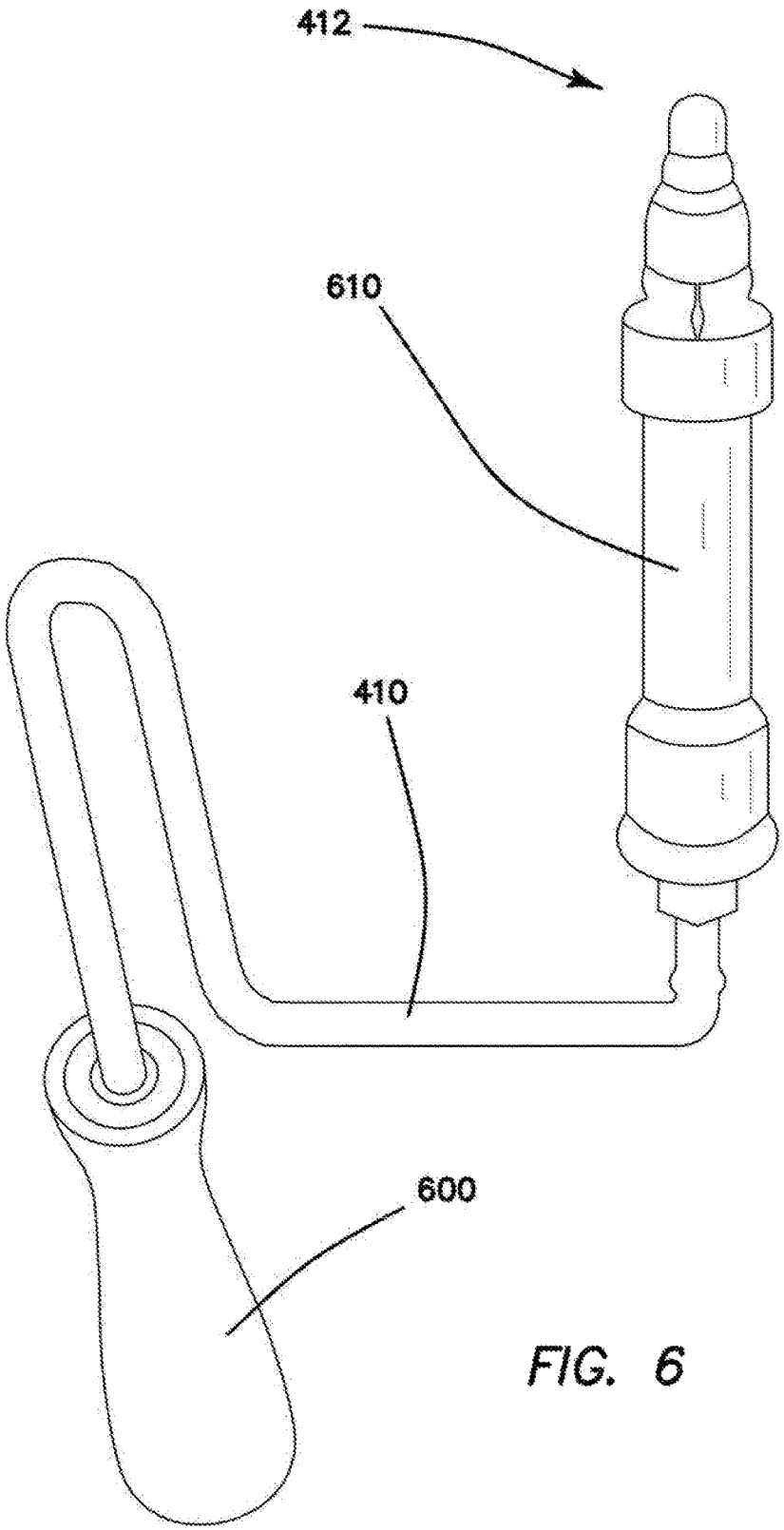
FIG. 6 shows the frame, roller, and handle.

FIG. 6 shows the frame 410, roller 610, and handle 600. This is the structure that a roller cover 400 and shield 100 are attached to. The roller 610 is where the roller cover 400 is placed. In this embodiment the roller 610 has a ¾ inch outer diameter while the roller cover 400 has an inner diameter of ¾ inch and a length of 4 inches.

Figure 7:
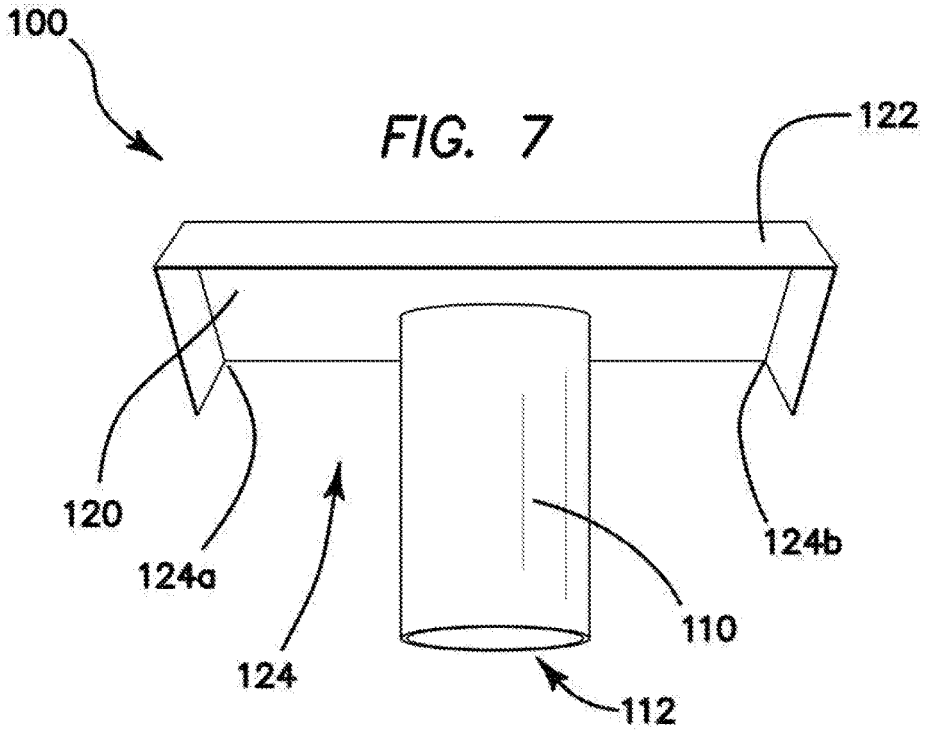
FIG. 7 shows an alternate configuration for the shield.

FIG. 7 shows an alternate configuration for the shield 100. In this particular alternate configuration the shield 100 is of a square design containing a beveled edge 122 along three of the edges and leaving a flat portion 124 with no beveled edge 122. The distance from 124*a* to 124*b* is at least as long as the outer diameter of the roller cover 400.

In another embodiment the roller and roller cover may differ from the 4 inch length. The most commonly used lengths would be between 4 to 6 inches.

In another embodiment, referring to FIGS. 8-13, a paint roller and paint roller shield assembly, comprises a roller for applying paint, having a paint applying surface that terminates at a rim located at an end of the roller. A paint roller shield 800 is connected to the end of the roller, and comprises a plate 120 with a planar surface having a substantially round and beveled peripheral edge 810 and a curved cutout 820 configured as a missing portion of the plate. The beveled peripheral edge 810 is angled and sloped outwardly away from the planar surface 120. In a plan view of the plate, for example, in FIGS. 12 and 13, the cutout 820 exposes a part of the rim 400 comprising part of the paint applying surface of the roller and wherein the plate and the beveled peripheral edge covers a remaining part of the rim of the roller not exposed by the cutout.

Figure 8:
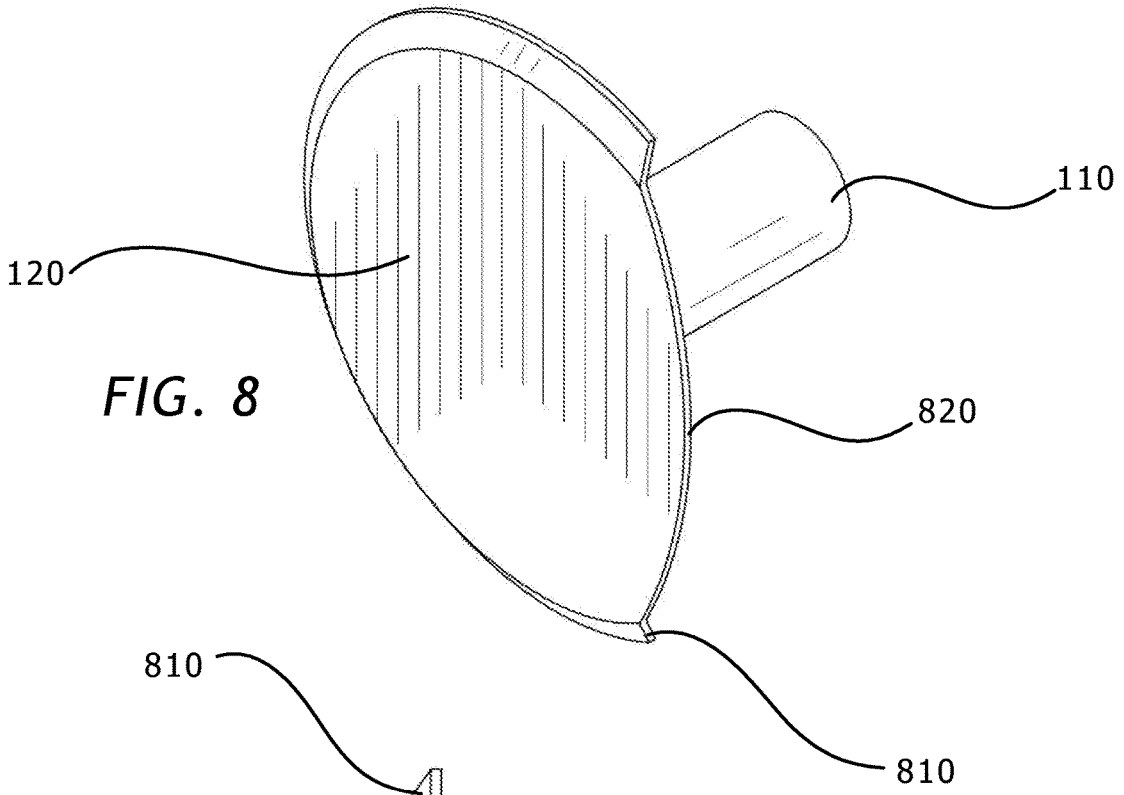
FIG. 8 is a perspective view of a paint roller shield with a curved cutout.
Figure 9:
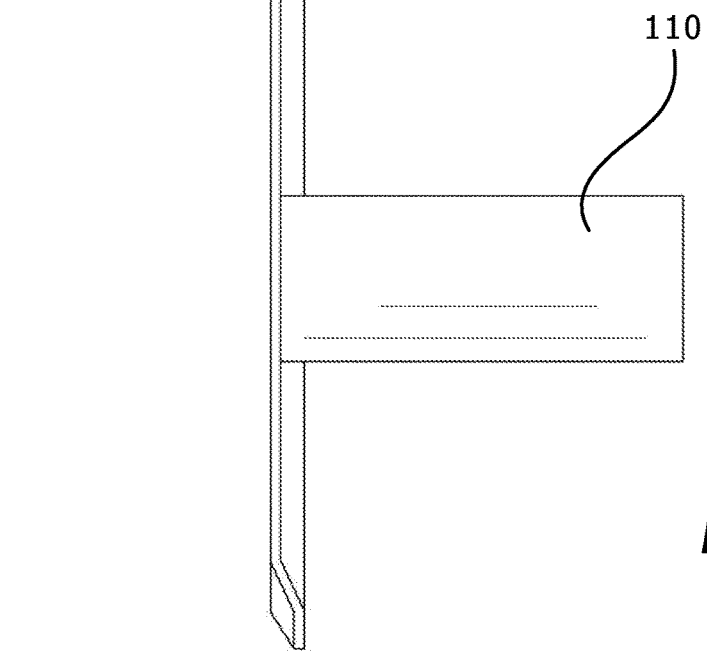
FIG. 9 is a side view of the paint roller shield with a curved cutout.
Figure 10:
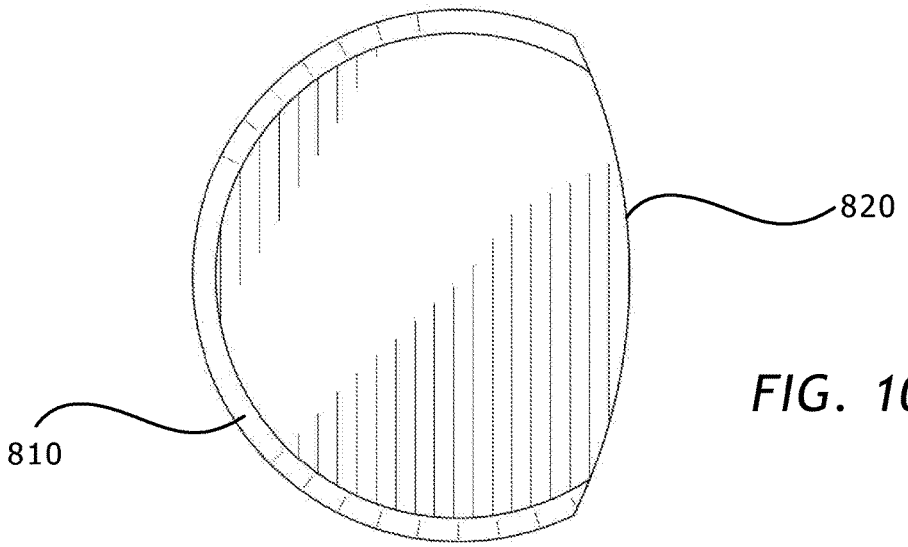
FIG. 10 is a plan view of a paint roller shield with a curved cutout.
Figure 11:
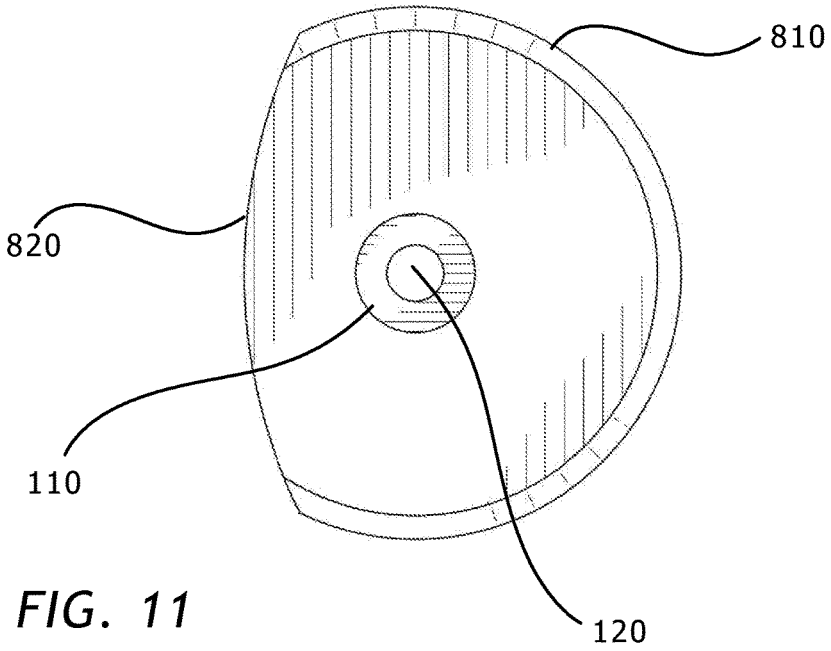
FIG. 11 is a rear view of a paint roller shield with a curved cutout.
Figure 12:
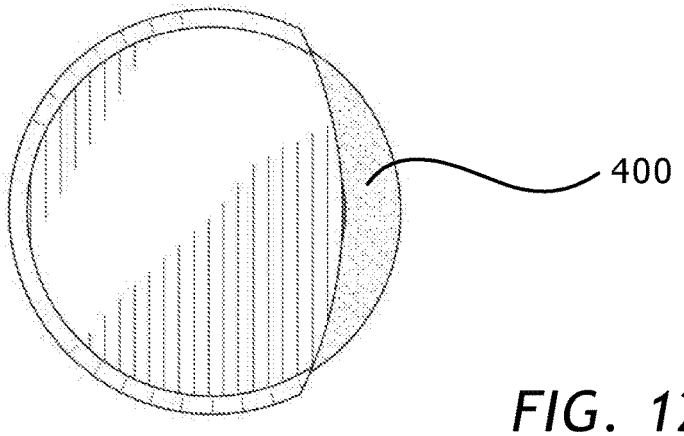
FIG. 12 is a plan view a paint roller shield with a curved cutout connected to a paint roller, wherein part of the paint applying surface is exposed by the curved cutout, and the remaining paint applying surface is covered by the roller shield.
Figure 13:
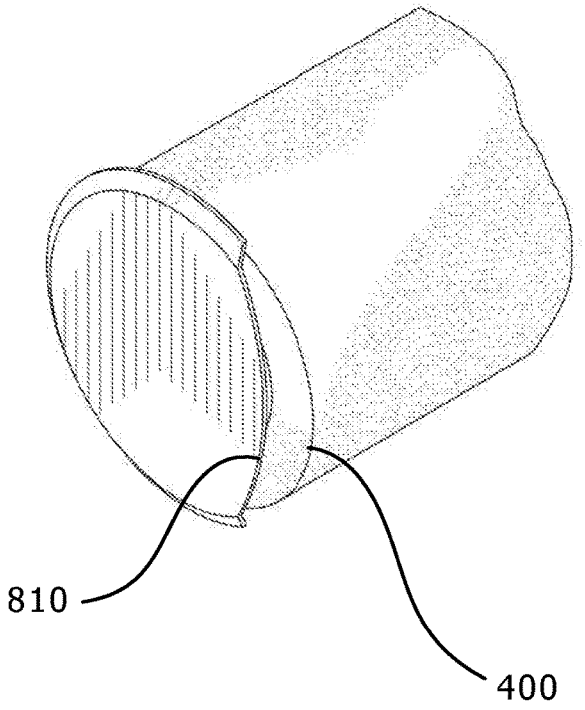
FIG. 13. is a perspective view a paint roller shield with a curved cutout connected to a paint roller, wherein part of the paint applying surface is exposed by the curved cutout, and the remaining paint applying surface is covered by the roller shield.

In another embodiment, FIGS. 8 and 9 show two different perspective views of the shield 800. In this embodiment, the shield 800 may have a stem 110 and a plate 120. The stem 110 is generally cylindrical and has a hollow interior 112 leading to the exterior on one side. The stem 110 is connected to the middle of the plate 120 at the other side. The plate 120 is generally flat and round. The plate 120 has a beveled edge 810 extending downwards from the plate. In one example, the beveled edge 810 is at a 45 degree angle, though it can range from near 0 to 90 degrees.

In one embodiment, the angle subtended by the curved cutout 820 is 129 degrees. Optionally, the angle subtended may be varied from 119 to 139 degrees. Optionally the beveled edge may be near 0.1 inch to 1.0 inch in length in the radial direction. The length and size may be scaled to suit the particular roller.

In one embodiment, the edge of the curved cutout 820 has radius of curvature that is larger than that of the beveled peripheral edge 810. For example, the peripheral edge of the curved cutout 820 may have a radius of curvature of 1.657 inches while that of the beveled peripheral edge 810 is 0.83 inches. The length of the arc of the curved cutout may be computed as: (angle subtended by cutout/360) times 2 pi times the radius of curvature of the curved cutout.

What is claimed is:

1. A paint roller and paint roller shield assembly, comprising:

a roller for applying paint, having a paint applying surface that terminates at a rim located at an end of the roller;

a paint roller shield, connected to the end of the roller, comprising:

a plate with a planar surface having a substantially round and beveled peripheral edge and a curved cutout configured as a missing portion of the plate;

wherein the beveled peripheral edge is angled and sloped outwardly away from the planar surface;

wherein in a plan view of the plate, the cutout exposes a part of the rim comprising part of the paint applying surface of the roller and wherein the plate and the beveled peripheral edge covers a remaining part of the rim of the roller not exposed by the cutout.

2. The paint roller and paint roller shield assembly of claim 1, wherein the beveled peripheral edge is angled between 0° and 90°.

3. The paint roller and paint roller shield assembly of claim 1, wherein the curved edge is unbeveled.

4. The paint roller and paint roller shield assembly of claim 1, wherein the shield is configured with a diameter of at least 1.5 inches to accommodate a 4 inch roller with an inner diameter of 0.75 inches.

5. The paint roller and paint roller shield assembly of claim 1, comprising a hollow cylindrical tube configured to fit over the end of the roller and remains rotatably fixed in relation to the roller when the roller rotates.

6. The paint roller and paint roller shield assembly of claim 1, wherein the curved cutout has an edge with a radius of curvature that is larger than a radius curvature of the peripheral edge.

7. A paint roller and paint roller shield assembly, comprising:

a roller for applying paint, having a paint applying surface that terminates at a rim located at an end of the roller;

a paint roller shield, connected to the end of the roller, comprising:

a plate with a planar surface having a substantially round and beveled peripheral edge and a cutout defined by a missing portion of the plate;

a hollow cylindrical tube configured to fit over the end of the roller and remains rotatably fixed in relation to the roller when the roller rotates, which applies paint;

wherein in a plan view of the plate, the cutout exposes a part of the rim comprising part of the paint applying surface of the roller and wherein the plate and the beveled peripheral edge covers a remaining part of the rim of the roller not exposed by the cutout.

8. The paint roller and paint roller shield assembly of claim 7, wherein the cutout has a flat portion defined by a secant.

9. The paint roller and paint roller shield assembly of claim 8, wherein the beveled peripheral edge is angled between 5° and 85° and slopes outwardly away from the planar surface.

10. The paint roller and paint roller shield assembly of claim 7, wherein the cutout has a curved edge.

11. The paint roller and paint roller shield assembly of claim 10, wherein the curved cutout has an edge with a radius of curvature that is larger than a radius curvature of the peripheral edge.

12. The paint roller and paint roller shield assembly of claim 7, wherein the peripheral edge is unbeveled.

13. The paint roller and paint roller shield assembly of claim 7, wherein the shield is configured with a diameter of at least 1.5 inches to accommodate a 4 inch roller with an inner diameter of 0.75 inches.

14. A paint roller shield, comprising:

a plate with a planar surface having a substantially round and beveled peripheral edge and a curved cutout configured as a missing portion of the plate;

wherein the beveled peripheral edge is angled and sloped outwardly away from the planar surface;

wherein in a plan view of the plate, and when connected to the shield, the cutout exposes a part of a rim of a paint applying surface of a roller and wherein the plate and the beveled peripheral edge covers a remaining part of the rim of the roller not exposed by the cutout.

15. A paint roller shield of claim 14, wherein the curved cutout has an edge with a radius of curvature that is larger than a radius curvature of the peripheral edge.

* * * * *